US008276411B2

(12) United States Patent
Thomas, II

(10) Patent No.: US 8,276,411 B2
(45) Date of Patent: Oct. 2, 2012

(54) EXTENDER FOR SECURING A CLOSURE

(75) Inventor: Patrick A. Thomas, II, Clinton, TN (US)

(73) Assignee: Babcock & Wilcox Technical Services Y-12, LLC, Oak Ridge, TN (US)

( * ) Notice: Subject to any disclaimer, the term of this patent is extended or adjusted under 35 U.S.C. 154(b) by 241 days.

(21) Appl. No.: 11/935,590

(22) Filed: Nov. 6, 2007

(65) Prior Publication Data

US 2009/0113952 A1 May 7, 2009

(51) Int. Cl.
*E05B 65/00* (2006.01)

(52) U.S. Cl. ..... 70/93; 70/14; 70/262

(58) Field of Classification Search ..... 70/14, 77, 70/91, 93, 101, 456 R, 459; 292/262, 259 R, 292/103, 104, 106, 281, 283, 284; 24/600.6, 24/600.8, 298–302

See application file for complete search history.

(56) References Cited

U.S. PATENT DOCUMENTS 1,176,407 A * 3/1916 Shirey ..... 292/259 R
1,353,026 A * 9/1920 Clare ..... 24/600.8
1,420,912 A * 6/1922 Davis ..... 292/282
1,874,632 A * 8/1932 Sanon ..... 292/106
2,130,216 A * 9/1938 Zaninovich ..... 292/259 R
2,283,983 A * 5/1942 Gibson ..... 292/106
2,426,793 A * 9/1947 Schwartz ..... 292/106
2,827,322 A * 3/1958 Barbour et al. ..... 292/104
3,134,252 A * 5/1964 Mintz ..... 70/93
3,280,606 A * 10/1966 Howard et al. ..... 292/259 R
3,600,026 A * 8/1971 Savio et al. ..... 292/276
3,643,478 A * 2/1972 McPeake ..... 292/259 R
3,715,900 A * 2/1973 Sherman ..... 70/456 R
3,736,781 A * 6/1973 Foote ..... 70/456 R
4,079,607 A * 3/1978 Spruyt ..... 70/456 R
4,419,874 A * 12/1983 Brentini ..... 70/459
4,488,417 A * 12/1984 Werner ..... 70/253
4,560,191 A * 12/1985 Grassi ..... 292/264
4,667,993 A * 5/1987 Hannesson et al. ..... 24/298
4,819,461 A * 4/1989 Pearson ..... 70/14
4,821,543 A * 4/1989 Scungio ..... 70/456 R
4,900,075 A * 2/1990 Smith ..... 292/263
4,974,889 A * 12/1990 North ..... 292/259 R
4,998,425 A * 3/1991 Hoogland ..... 70/164

(Continued)

*Primary Examiner* — Christopher Boswell

(74) *Attorney, Agent, or Firm* — Michael J. Renner, Esq.; Luedeka Neely Group, P.C.

(57) ABSTRACT

An apparatus for securing a closure such as door or a window that opens and closes by movement relative to a fixed structure such as a wall or a floor. Many embodiments provide a device for relocating a padlock from its normal location where it secures a fastener (such as a hasp) to a location for the padlock that is more accessible for locking and unlocking the padlock. Typically an extender is provided, where the extender has a hook at a first end that is disposed through the eye of the staple of the hasp, and at an opposing second end the extender has an annulus, such as a hole in the extender or a loop or ring affixed to the extender. The shackle of the padlock may be disposed through the annulus and may be disposed through the eye of a second staple to secure the door or window in a closed or open position. Some embodiments employ a rigid sheath to enclose at least a portion of the extender. Typically the rigid sheath has an open state where the hook is exposed outside the sheath and a closed state where the hook is disposed within the sheath.

4 Claims, 6 Drawing Sheets

U.S. PATENT DOCUMENTS 5,003,672 A * 4/1991 Randall ..... 24/300
5,039,147 A * 8/1991 Moon et al. ..... 292/262
5,119,649 A * 6/1992 Spence ..... 70/18
5,163,206 A * 11/1992 Hernandez ..... 24/299
5,297,828 A * 3/1994 Chung ..... 292/262
5,340,172 A * 8/1994 Sweet ..... 292/259 R
5,588,687 A * 12/1996 Pinkerton ..... 292/259 R
5,752,401 A * 5/1998 MacDonald ..... 70/459
5,772,266 A * 6/1998 Skiba ..... 292/259 R
5,832,754 A * 11/1998 McKenzie ..... 70/58
5,927,107 A * 7/1999 Mitchell ..... 292/259 R
6,360,408 B1 * 3/2002 Dykstra et al. ..... 24/598.7
6,513,852 B1 * 2/2003 Krist et al. ..... 296/50
6,619,708 B1 * 9/2003 Naylor ..... 292/259 R
6,705,652 B2 * 3/2004 Engel ..... 292/259 R
6,755,053 B1 * 6/2004 Dias ..... 70/14
7,226,091 B2 * 6/2007 Amy ..... 292/262
2004/0250576 A1 * 12/2004 Flanders, Jr. ..... 70/14

* cited by examiner

EXTENDER FOR SECURING A CLOSURE

GOVERNMENT RIGHTS

The U.S. Government has rights to this invention pursuant to contract number DE-AC05-00OR22800 between the U.S. Department of Energy and BWXT Y-12, L.L.C.

FIELD

This disclosure relates to the field of locks and securing devices. More particularly, this disclosure relates to devices for repositioning a lock for easier access and increased security.

BACKGROUND

Padlocks are often used to secure articles, cases, windows, doors and similar items that require protection from unauthorized usage or entry. Sometimes the point of application of a padlock is inconvenient for physical access. For example, a padlock may be installed at an elevation that is hard to reach or at a location where the level of ambient light is inadequate to easily orient the key in the slot of a keyed padlock or to read the numbers on a combination padlock. Another problem is that sometimes padlocks are used inefficiently. For example, in some circumstances multiple padlocks may be used where a single padlock could be applied if there were a way to physically secure two locking mechanisms with a single padlock. What are needed therefore are improved devices to spatially extend the physical security enabled by a padlock.

SUMMARY

The present disclosure provides an apparatus for securing a closure that opens and closes by movement relative to a fixed structure. The apparatus has a first annular fastener that has a first eye. The first annular fastener is operatively secured to a first fixing surface that is either the closure or the fixed structure. The apparatus also includes an extender that has at a first end a hook with a tip. The extender also has an annulus at a second end that is distal from the first end. The hook is disposed through the first eye. There is a second annular fastener that has a second eye. The second annular fastener is operatively secured to a second fixing surface that is either the closure or the fixed structure, but one of (a) the first fixing surface and (b) the second fixing surface is on a surface of the fixed structure and the other of (a) the first fixing surface and (b) the second fixing surface is on a surface of the closure. There is a shackle that is disposed through the second eye and the annulus, wherein movement of the closure relative to the fixed structure is limited to a fixed amount. Further, the extender may be detached from the closure and the fixed structure by removing the shackle from the annulus and removing the hook from the first eye.

A further embodiment provides an apparatus for securing a closing fastener to an annular fastener. The apparatus has an extender having a length and a first end and an opposing second end. There is a hook with a tip that is disposed at the first end of the extender and an annulus that is disposed at the second end of the extender. Further, the apparatus has a rigid sheath that has an enclosing end and a locking end. The rigid sheath is configured to enclose a portion of the length of the extender between the hook and annulus. The rigid sheath is further configured to slide relative to the extender between (1) a closed state wherein the tip of the hook is enclosed within the enclosing end of the rigid sheath and the annulus is disposed outside the locking end of the rigid sheath and (2) an open state wherein the tip of the hook is disposed outside the enclosing end of the rigid sheath and the annulus is disposed within the locking end of the sheath.

Another embodiment provides an apparatus for securing an article in a protective case. The apparatus has a first annular fastener that is operatively secured to the case, and the first annular fastener has a first eye. There is an extender that has at a first end a hook with a tip and the extender also has an annulus at a second end distal from the first end. The hook is disposed through the first eye. There is a rigid sheath that is configured to enclose the tip of the hook. There is a second annular fastener that is operatively secured to the case distal from the first annular fastener. The second annular fastener has a second eye. Further there is a shackle that is configured to pass through the second eye and the annulus of the extender to secure the extender to the second annular fastener, wherein the sheath and the extender are configured to prevent the removal of the article from the case.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

In the following detailed description of the preferred embodiments, reference is made to the accompanying drawings, which form a part hereof, and within which are shown by way of illustration the practice of specific embodiments of apparatuses for securing a closure that opens and closes by movement relative to a fixed structure and embodiments of apparatuses for securing an article in a protective case. It is to be understood that other embodiments may be utilized, and that structural changes may be made and processes may vary in other embodiments.

Figure 1:
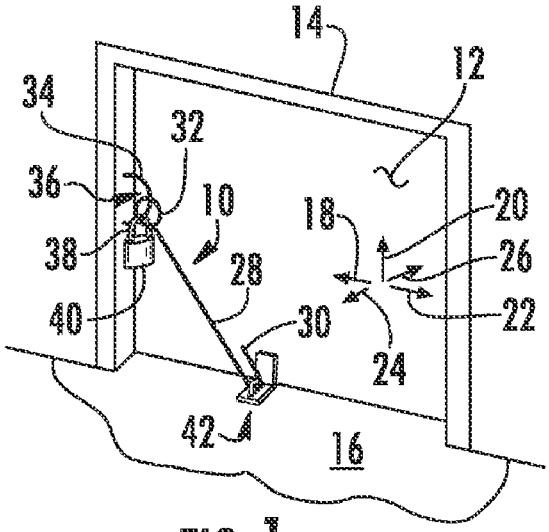
FIG. 1 is a somewhat schematic perspective illustration of an apparatus for securing a door.

FIG. 1 illustrates an embodiment of an apparatus 10 for securing a door 12. The door 12 is an example of a closure. A "closure" is a structure such as a door, window, or gate that is designed to be moved between an open and a closed position to provide or deny access to a compartment, a room, an outdoor area, or a facility. However, the term closure as used herein does not include a device that, when the device is in a closed position, permits substantially unrestricted passage of an object or person having a dimension (height, length, or width) that is less than approximately eighteen inches. Thus, for example, a bar or a chain across a driveway is not a "closure" as the term is used herein.

In the configuration illustrated in FIG. 1 the door 12 is in a closed position and the apparatus 10 is used to secure the door 12 in the closed position. However, in alternate embodiments the apparatus 10 may be used to secure the door 12 in an open position. The door 12 is set in a frame 14 that is secured to a floor 16. It is understood that in some embodiments the floor 16 may be the ground and in some embodiments the floor 16 may be a portion of a building or a structure. The frame 14 and the floor 16 are examples of fixed structures. Fixed structures are structures that do not move when an associated closure is moved between its open and closed positions. Furthermore, the frame 14 and the floor 16 do not move relative to each other, so they constitute portions of a combined fixed structure. The door 12 may be configured to move relative to the frame 14 and the floor 16 in one or more translocation directions 18, 20, 22, 24, and/or 26 in order to move the door 12 to its open configuration. In some embodiments the door 12 may be configured to move relative to the frame 14 in a sixth direction that is opposite direction 20 (i.e., into the floor 16) but such configurations are not common. In some embodiments the door 12 may move in vectored combinations or rotational variations of the translocation directions 18, 20, 22, 24 and/or 26, such as in embodiments where the door 12 is a swinging door.

The apparatus 10 includes an extender 28. In the embodiment of FIG. 1 the extender 28 is a rigid rod, but in some embodiments the extender 28 may be a chain or a flexible strap. A hook 30 is disposed at one end of the extender 28 and a loop 32 is disposed at second end of the extender 28, distal from the first end. The loop 32 is an example of an "annulus." An annulus is a component or a feature of a component that resembles a ring. A link in a chain is an annulus, and a hole in a rod is another example of an annulus.

A staple 34 is operatively secured to the frame 14 by threaded fasteners. As used herein, the term "operatively secured" (or variations thereof such as "operatively securing" and "operatively secure") refers to an arrangement of the recited elements that establishes a mechanical connection between the recited elements, either by direct attachment of the elements together or by connection of the recited elements through one or more intervening elements. In the embodiment of FIG. 1 the frame 14 is operatively secured to the floor 16 by standard construction techniques. Therefore the staple 34 is operatively secured to the floor 16 by virtue of the fact that the staple 14 is operatively secured to the frame 14 and the frame 14 is operatively secured to the floor 16.

The staple 34 has an eye 36 and the staple 34 is an example of an annular fastener. An annular fastener is a fastener that has an eye (e.g., the eye 36) through which a hook, shackle, ring, clip, bolt, or similar device may be passed for operatively securing such a device to the annular fastener (e.g., the staple 34). An eyebolt is another example of an annular fastener. In the embodiment of FIG. 1, a shackle 38 of a padlock 40 passes through the loop 32 and the eye 36 of the staple 34 to operatively secure the extender 28 to the staple 34.

Figure 2:
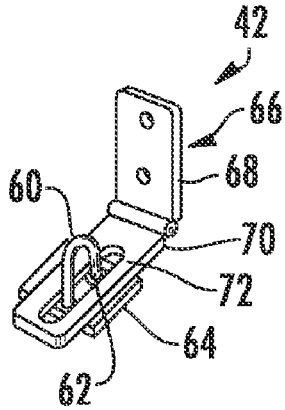
FIG. 2 is a somewhat schematic perspective illustration of a hasp.

The hook 30 is engaged with a hasp 42, illustrated in further detail in FIG. 2. As seen in FIG. 2, the hasp 42 includes a staple 60 with an eye 62. The staple 60 may be operatively secured to the floor 16 directly or (in the embodiment of FIG. 2) through a staple plate 64. The hasp 42 also has a hinged strap 66 having a first portion 68 that is operatively secured to the door 12 and a second portion 70 that has a slot 72 configured to span the staple 60. The hinged strap 66 of the hasp 42 is an example of a closing fastener. A closing fastener is a fastener that may be operatively secured to an annular fastener by the use of a single hook, shackle, ring, clip, bolt, or similar device through the eye of an annular fastener. For example, when the second portion 70 of the hinged strap 66 is disposed on the staple 60 (as illustrated in FIG. 2) and the hook 30 is disposed through the eye 62 of the staple 60 (as illustrated in FIG. 1), the hinged strap 66 is operatively secured to the staple 60.

Note further in that the configuration of FIG. 1 and FIG. 2 illustrates an apparatus 10 for securing a closure (the door 12) that opens and closes by movement relative to a fixed structure (the frame 14) that includes (1) a first annular fastener (staple 60) having a first eye (62). The first annular fastener (the staple 60) is operatively secured to a "first fixing surface" (the door 12, by virtue of the combination of the hook 30 and the hinged strap 66 acting as intermediate securing elements between the staple 60 and the door 12 to operatively secure the staple 60 to the door 12). There is also (2) an extender 28 that has a hook 30 at a first end and an annulus (the loop 32) at a second end distal from the first end. Further, the hook 30 is disposed through the first eye 62. There is also (3) a second annular fastener (staple 34) having a second eye (36), and the second annular fastener is operatively secured to a second fixing surface (the frame 14, a fixed structure). There is also (4) a shackle (38) that is disposed through the second eye (36) and the annulus (the loop 32). The hook 30, the first annular fastener (the staple 60), the extender (28), the second annular fastener (the staple 34) and the shackle (38) restrict movement of the closure (the door 12) relative to the fixed structure (the frame 14 and the floor 16 as a combined fixed structure). Note that the extender 28 is operatively secured to the fixed structure (the frame 14 and the floor 16 as a combined fixed structure) only via the loop 32 and the hook 30, wherein the extender 28 may be detached from the closure and the fixed structure by removing the shackle 38 from the loop 32 and removing the hook 30 from the first eye 32.

The components of the apparatus 10 in FIG. 1 are configured so that the position of the padlock 40 is at an elevation that is more convenient for physical access than if the padlock 40 were secured directly to the hasp 42, the staple 60 of which is on the floor 16. In such applications the extender 28 is typically at least approximately two feet long. Such a length provides utility because typically at least a two-foot displacement of a padlock (e.g., the padlock 40) is needed to relocate it from an inconvenient location to a convenient location, particularly (as in FIG. 1) when the unextended (inconvenient) location is on a floor (e.g., the floor 16).

However, it should also be noted that is possible to install the apparatus 10 "upside-down" from the configuration illustrated in FIG. 1. In such a configuration the hook 30 is disposed through the eye 36 of the staple 34 and the shackle 38 of the padlock 40 is disposed through the eye 62 of the staple 60 and through the loop 32. The resultant configuration also includes (1) a first a annular fastener (the staple 34 in this case) having a first eye (the eye 36) that is operatively secured to a first fixing surface (the frame 14), and (2) an extender 28 having a hook 30 at a first end and having an annulus (the loop 32) at a second end where the hook 30 is disposed through the first eye 36, and (3) a second annular fastener (the staple 60) having a second eye (the second eye 62) where the second annular fastener (the staple 60) is operatively secured to a second fixing surface (the closure 12, by virtue of the shackle 38 and the hinged strap 66 acting as intermediate securing elements between the staple 60 and the closure 12 to secure the staple 60 to the closure 12) and (4) a shackle (the shackle 38) that is disposed through the second eye (the second eye 62) and the annulus (the loop 32).

The movement of the door 12 is limited to the amount of mechanical play between the second portion 70 of the hinged strap 66 and the staple 60 with the hook 30 disposed through the eye 62 of the staple 60. Typically when the hook 30 and the hasp 42 are in the configuration of FIG. 1, it is desired to limit the amount of movement of the door 12 in any of the translation directions 18, 20, 22, 24 or 26 to less than approximately one inch. However, in some embodiments it may be desirable to provide movement up to approximately six inches, in order to provide air circulation through the partially opened door 12. In some embodiments it may be desirable to provide movement up to approximately twelve inches in order to permit animals or objects with a dimension less than twelve inches to pass through the partially opened door while preventing the passage of larger animals or objects.

Generally it is desirable that one of (a) the first fixing surface and (b) the second fixing surface is operatively secured to a surface of the fixed structure and the other of (a) the first fixing surface and (b) the second fixing surface is operatively secured to a surface of the closure. For example, in a variation of the configuration of FIGS. 1 and 2, the staple 34 may be operatively secured to the closure (i.e., the door 12) and such embodiments will preform substantially as well in securing the door 12 from movement relative to the fixed structure (i.e., the frame 14 and the floor 16 that constitute portions of a combined fixed structure). This variation provides substantially equivalent performance to the configuration actually depicted in FIGS. 1 and 2 due to the fact that the staple 60 is operatively secured to the floor 16 so that one of (a) the first fixing surface and (b) the second fixing surface is operatively secured to a surface of the fixed structure and the other of (a) the first fixing surface and (b) the second fixing surface is operatively secured to a surface of the closure. On the other hand, the fact that the staple 60 is operatively secured to the door 12 (by virtue of the hook 30 and the hinged strap 66 acting as intermediate securing elements between the staple 60 and the door 12) is not sufficient to provide equivalent performance because if the staple 34 is operatively secured only to the door 12 and the staple 60 is also operatively secured only to the door 12 (and not also to the floor 16), the apparatus 10 would not secure the door 12 in the closed position.

Note that if in a variation of the configuration of FIGS. 1 and 2, the staple 34 is operatively secured to the closure (i.e., the door 12), and if the extender 28 is a rigid rod, and if the hook 30 is engaged with the staple 60 which is operatively secured to the floor 16, there is no strict need for the hinged strap 66. The hinged strap 66, which is operatively secured to the door 12, in combination with the staple 60 and the hook 30 does provide additional security in maintaining the door 12 in the closed position. However, if the staple 34 is operatively secured to the closure (i.e., the door 12), then a rigid rod extender 28 in the configuration of FIG. 1 without the hinged strap 66 prevents any substantial movement of the door 12 relative to the fixed structure (the frame 14 and the floor 16 that constitute portions of a combined fixed structure).

Figure 3:
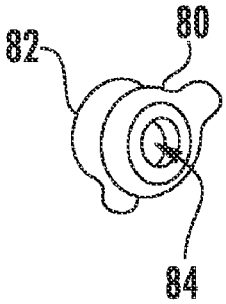
FIG. 3 is a somewhat schematic perspective illustration of two eye-bolts.

FIG. 3 illustrates two eyebolts 80 and 82 that are configured as an alternative to the hasp 42 of FIG. 2. For example the first eyebolt 80 may substitute for the hinged strap 66 and the second eyebolt 82 may substitute for the staple 60. However in this substitution the first eye bolt 80, which attaches directly to the door 12, may be designated as an annular fastener (unlike its counterpart fastener [the hinged strap 66, a closing fastener] for which it is substituting), and the second eyebolt 82, which attaches directly to the floor 16, may be designated a closing fastener (unlike its counterpart fastener [the staple 60, an annular fastener] for which it is substituting). That is, the first eyebolt 80 has an eye 84, and it is therefore an annular fastener as defined herein. The second eyebolt 82 is the closing fastener as defined herein because the second eyebolt 82 may be operatively secured to the first eyebolt 80 (that has been designated here as an annular fastener) by a single hook, shackle, ring, clip, bolt, or similar device disposed through the eye 84 of the first eyebolt 80. Note that it would be equally valid to designate the first eyebolt 80 as a closing fastener and the second eyebolt 82 as an annular fastener.

Figure 4:
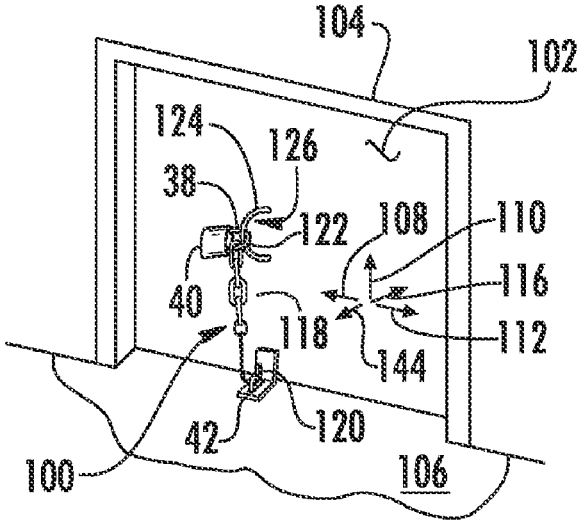
FIG. 4 is a somewhat schematic perspective illustration of an apparatus for securing a door.

FIG. 4 illustrates an embodiment of an apparatus 100 for securing a door 102. In the configuration illustrated in FIG. 4 the door 102 is in its closed configuration. The door 102 is set in a frame 104 that is secured to a floor 106. The frame 104 and the floor 106 do not move relative to each other, so they constitute portions of a combined fixed structure. The door 102 may be configured to move relative to the frame 104 and the floor 106 in one or more translocation directions 108, 110, 112, 114, and/or 116 in order to move the door 102 to its open configuration.

The apparatus 100 includes an extender 118. In the embodiment of FIG. 4 the extender is a chain. A hook 120 is disposed at one end of the extender 118 and a chain link 122 is disposed at second end of the extender 118, distal from the first end. The chain link 122 is an annulus.

A staple 124 having an eye 126 is operatively secured to the door 102. A shackle 38 of a padlock 40 passes through the chain link 122 and the eye 126 of the staple 124 to operatively secure the extender 118 to the staple 124. The hook 120 is engaged with a hasp 42, illustrated in further detail in FIG. 2.

The configuration of FIG. 4 (with further reference to details of the hasp 42 in FIG. 2) is illustrative of an embodiment of an apparatus 100 for securing a closure (the door 102) that opens and closes by movement relative to a fixed structure (the frame 104), where the apparatus includes (1) a first annular fastener (staple 60) having a first eye (62). The first annular fastener (the staple 60) is operatively secured to a "first fixing surface" (the floor 102 [a fixed structure]). There is also (2) an extender 118 that has a hook 120 at a first end and an annulus (the chain link 122) at a second end distal from the first end. Further, the hook 120 is disposed through the first eye 62. There is also (3) a second annular fastener (staple 124) having a second eye (126), and the second annular fastener is operatively secured to a second fixing surface (the door 102 [a closure]). There is also (4) a shackle (38) that is disposed through the second eye (126) and the annulus (the chain link 122). The hook 120, the first annular fastener (the staple 60), the extender (118), the second annular fastener (the staple 124) and the shackle (38) restrict movement of the closure (the door 102) relative to the fixed structure (the frame 104).

Note that in the configuration of FIG. 4 (with further reference to details of the hasp 42 in FIG. 2) the components are configured so there is no strict need for the hinged strap 66. The hinged strap 66, which is operatively secured to the door 12, in combination with the staple 60 and the hook 120 does provide additional security in maintaining the door 12 in the closed position. However, if the chain extender 118 is sufficiently taut, then the chain extender 118 in the configuration of FIG. 4 without the hinged strap 66 prevents any substantial movement of the door 102 relative to the fixed structure (the frame 104 and the floor 106 that constitute portions of a combined fixed structure).

Figure 5A:
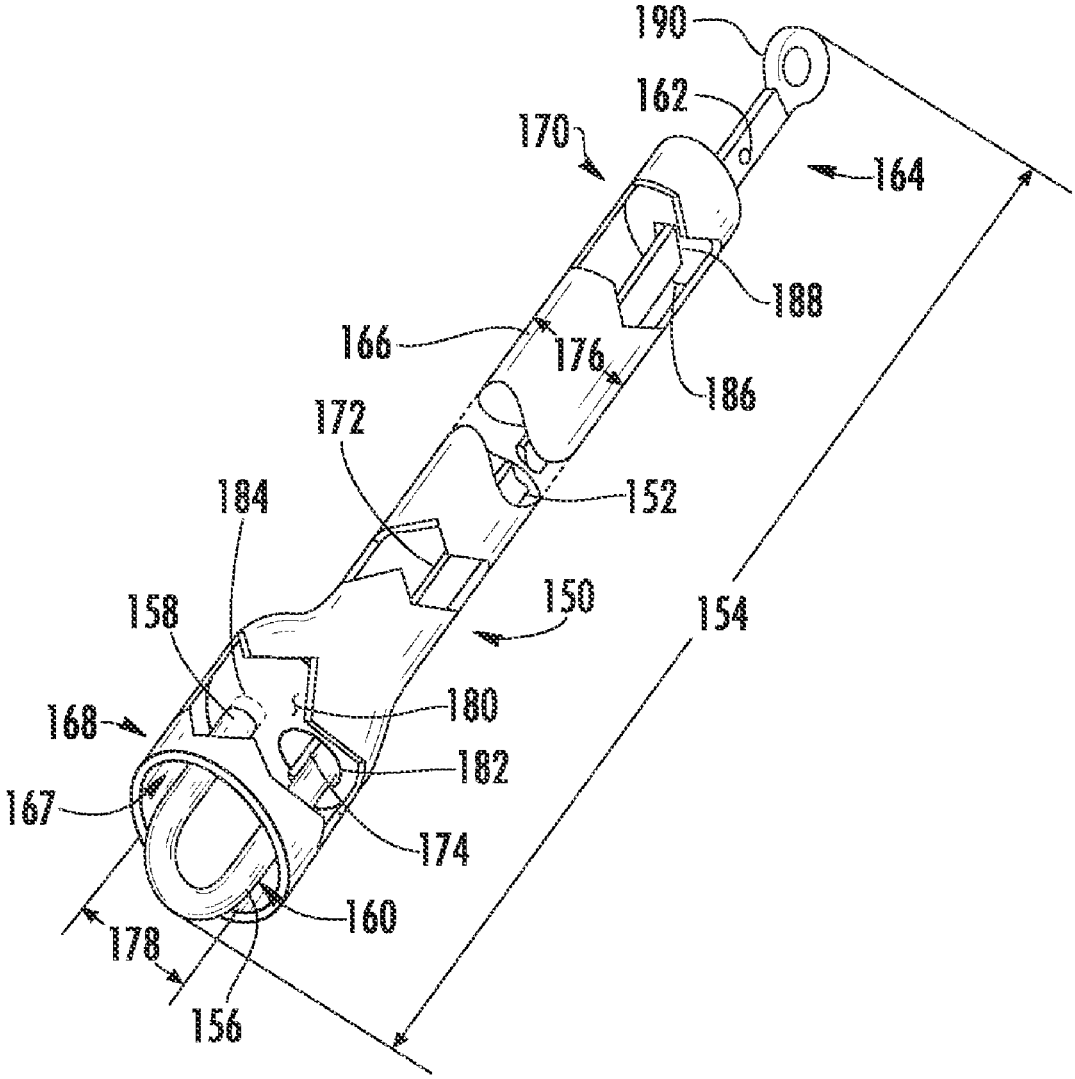
FIG. 5A is a somewhat schematic perspective illustration of an apparatus for securing a fastener, the apparatus shown in a closed state.
Figure 5B:
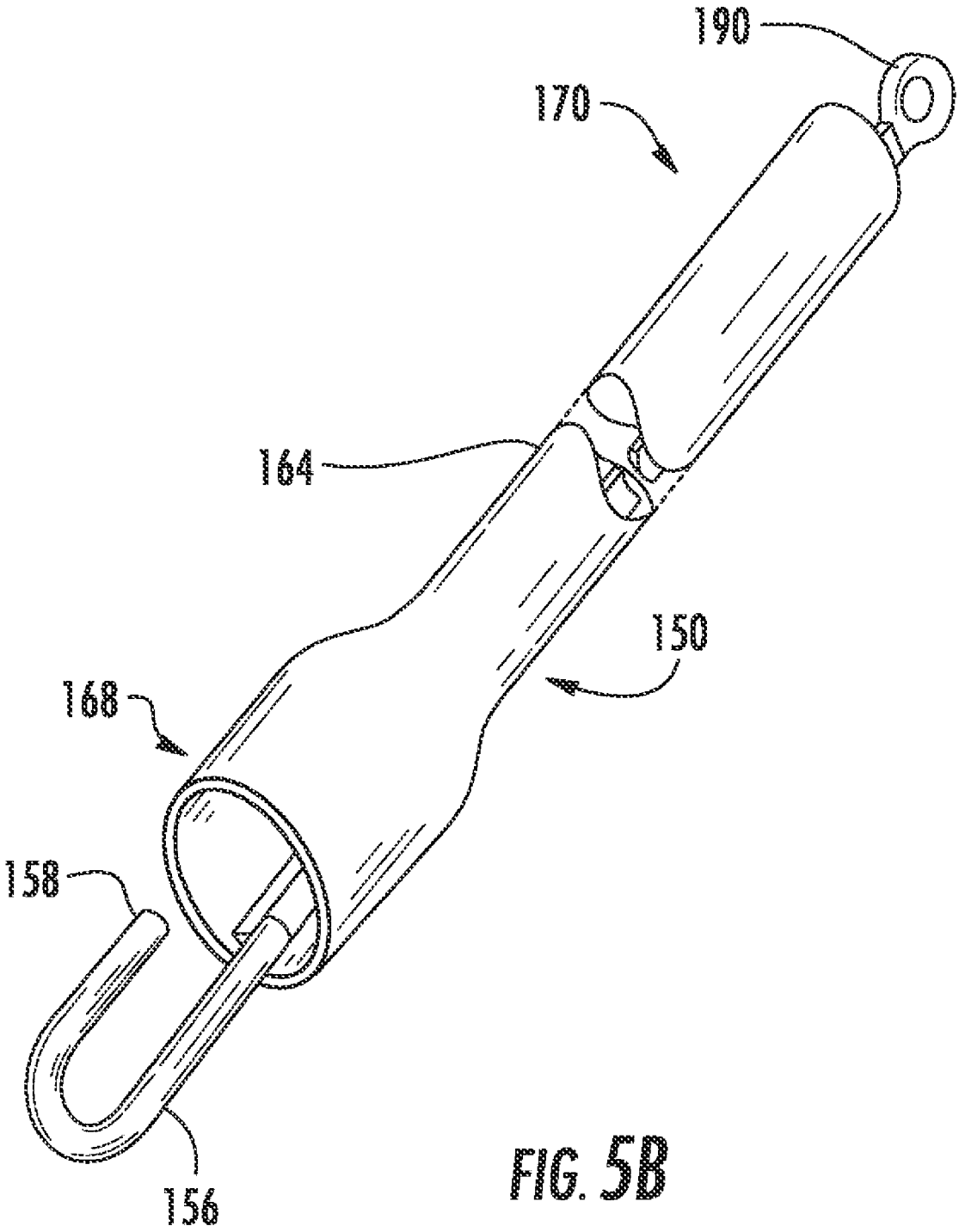
FIG. 5B is a somewhat schematic perspective illustration of the apparatus of FIG. 5A, shown in an open state.

FIGS. 5A and 5B illustrate an embodiment of an apparatus 150 for securing a closing fastener to an annular fastener. The apparatus 150 includes an extender 152 that has a length 154.

A hook 156 with a tip 158 is disposed at a first end 160 of the extender 152, and an annulus 162 is disposed at a second end 164 of the extender 152. The apparatus 150 also includes a tubular rigid sheath 166 that has an interior volume 167, and an enclosing end 168, and a locking end 170. The tubular rigid sheath 166 is configured to enclose at least a portion of the length of the extender 152 between the hook 156 and the annulus 162. The tubular rigid sheath 166 is further configured to slide relative to the extender 152 between (1) a first state (shown in FIG. 5A) where the tip 158 of the hook 156 is disposed within the interior volume 167 of the tubular rigid sheath 166 adjacent the enclosing end 168 of the tubular rigid sheath 166 and the annulus 162 is disposed outside the locking end 170 of the tubular rigid sheath 166, and (2) a second state (shown in FIG. 5B) where the tip 158 of the hook 156 is disposed outside the interior volume 167 of the tubular rigid sheath 166 adjacent enclosing end 168 of the tubular rigid sheath 166 and the annulus 162 (shown in FIG. 5A) is disposed within the interior volume 167 of the tubular rigid sheath 166 adjacent the locking end 170 of the sheath.

The terms "closed state" and "open state" have the following meanings when used herein. When a rigid sheath is in a closed state (as depicted in FIG. 5A), and a hook is disposed in the eye of an annular fastener, the tip of the hook is enclosed within the enclosing end of the rigid sheath. In the closed state the hook may not be removed from the eye of the fastener without either (1) breaking the hook, or the rigid sheath or the annular fastener, or (2) moving the rigid sheath to the open state. When a rigid sheath is in the open state as depicted in FIG. 5B, and the hook is disposed in the eye of an annular fastener, the tip of the hook is disposed outside the enclosing end of the rigid sheath and the hook may be removed from the eye of the annular fastener by sliding the hook out of the eye of the annular fastener.

In the embodiment illustrated in FIG. 5A, the extender 152 is constructed of a bar 172 that is welded to the hook 156 at location 174. The rigid sheath 166 is formed from circular cross-section tube stock having an outside diameter 176. At the enclosing end 168 of the rigid sheath 166 the tube stock has been formed in an ellipsoidal shape to accommodate enclosing the hook 156. The forming in an ellipsoidal shape at the enclosing end 168 permits the use of smaller diameter circular cross-section tube stock for the rigid sheath than if the entire rigid sheath 166 was formed from circular cross-section tube stock sized to accommodate the width 178 of the hook 156.

The apparatus 150 includes a barrier 180 disposed adjacent the enclosing end 168 of the rigid sheath 166. The bar 172 and the hook 156 pass through a barrier orifice 182 in the barrier 180. In some embodiments the barrier orifice 182 is positioned offset from the centroid of the barrier 180. Such an offset configuration, in combination with a selected geometry for the hook 156 and the closing end 168 of the rigid sheath 166 may be used to limit a rotation of the hook 156 within the enclosing end 168 of the rigid sheath 166. Such a limit on rotation increases resistance of the apparatus 150 to tampering. When the tip 158 of the hook 156 is slid into the enclosing end 168 of the rigid sheath 166 and the tip 158 reaches the position 184 depicted in FIG. 5A, the barrier 180 prevents the hook 156 (and therefore prevents the extender 152) from sliding further into the enclosing end 168 of the rigid sheath 166. This limitation on the insertion of the hook 156 into the enclosing end 168 of the rigid sheath facilitates inspection of the state of deployment of the hook 156 with respect to its engagement with a closing fastener and an annular fastener.

The apparatus 150 also includes a plate 186 disposed adjacent the locking end 170 of the rigid sheath 166. The bar 172 of the extender 152 passes through a plate orifice 188. A protuberance 190 is disposed at the end of the extender 152. The protuberance 190 may be a washer, a ring, or a non-annular structure that is welded to the extender 152. The protuberance 190 is sized to be larger than the plate orifice 188 so that the rigid sheath 166 may not be slid completely off the extender 152. FIG. 5B illustrates the approximate limit of travel of the rigid sheath 166 established by the protuberance 190.

Figure 6:
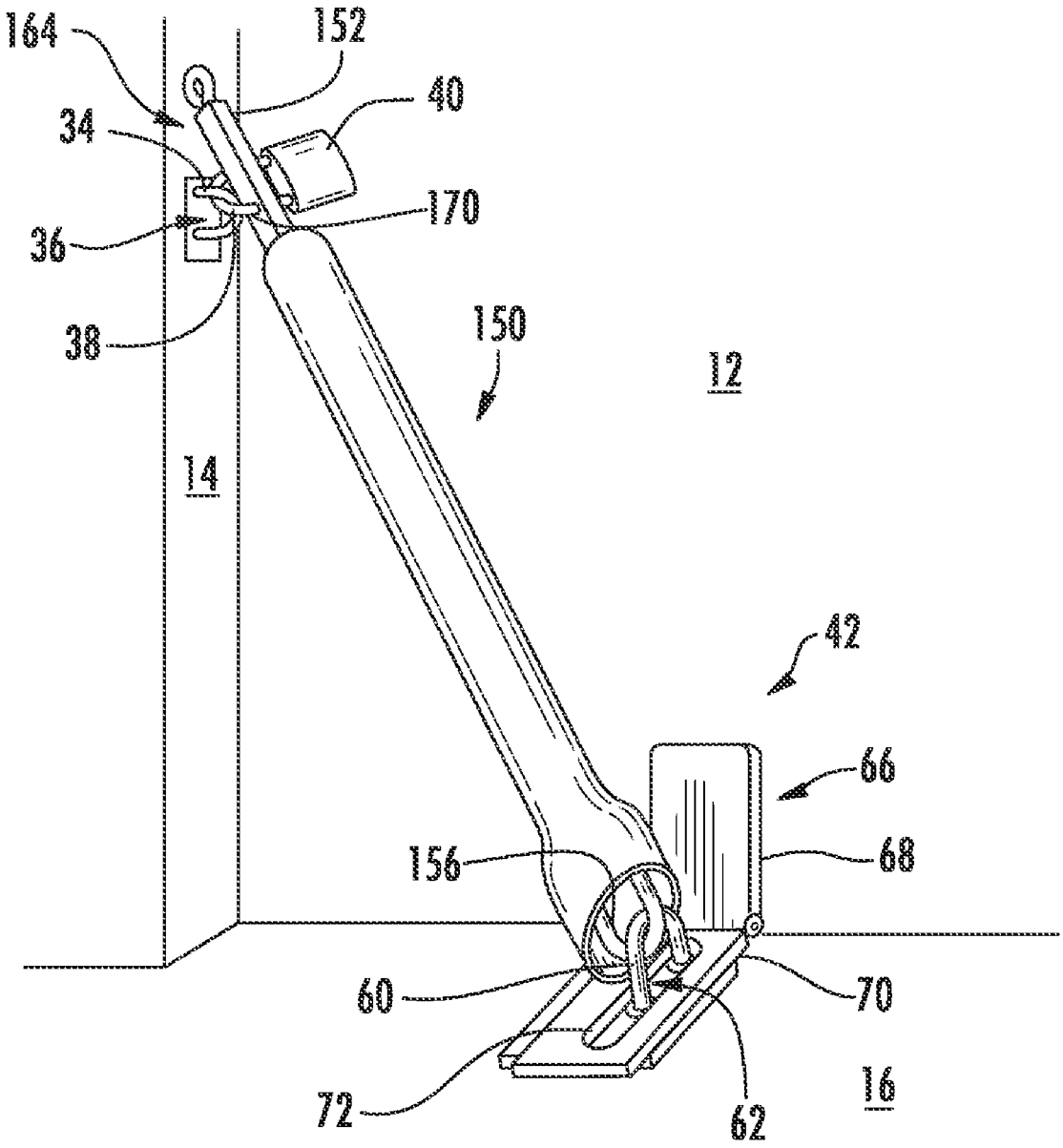
FIG. 6 is a somewhat schematic perspective illustration of the apparatus depicted in FIGS. 5A and 5B, configured to secure a door.

FIG. 6 illustrates the apparatus 150 of FIGS. 5A and 5B, deployed to secure a door 12 that opens and closes by movement relative to a floor 16. The embodiment of FIG. 6 includes a hasp 42 that includes a first staple 60 that has a first eye 62. The first staple 60 is operatively secured to the floor 16. The hasp 42 also has a hinged strap 66 having a first portion 68 that is operatively secured to the door 12 and a second portion 70 that has a slot 72 configured to span the first staple 60. The hook 156 of the apparatus 150 is disposed through the first eye 62 in a configuration that operatively secures the staple 60 to the second portion 70 of the hinged strap 66 of the hasp 42. A shackle 38 of a padlock 40 is disposed through the annulus 162 of the extender 152 and through a second eye 36 of a second staple 34. In this configuration of FIG. 6 a movement of the door 12 relative to the floor 16 is limited to not more than approximately one inch. It should be noted that in a variation of the configuration of FIG. 6 the shackle 38 of the lock does not pass through the second eye 36 of the second staple 34, and such configuration is still effective because an attachment of the extender 152 to the second staple 34 is not needed to limit a movement of the door 12 relative to the floor 16. However, it is preferred to pass the shackle 38 of the lock through the second eye 36 of the second staple 34 as depicted in FIG. 6 because attaching the second end 164 of the extender 152 to the frame 14 (or to the door 12) keeps the apparatus 150 out of the way so as to not be a tripping hazard and improves security by preventing attempts to use the apparatus 150 to pry the first staple 60 loose.

Figure 7:
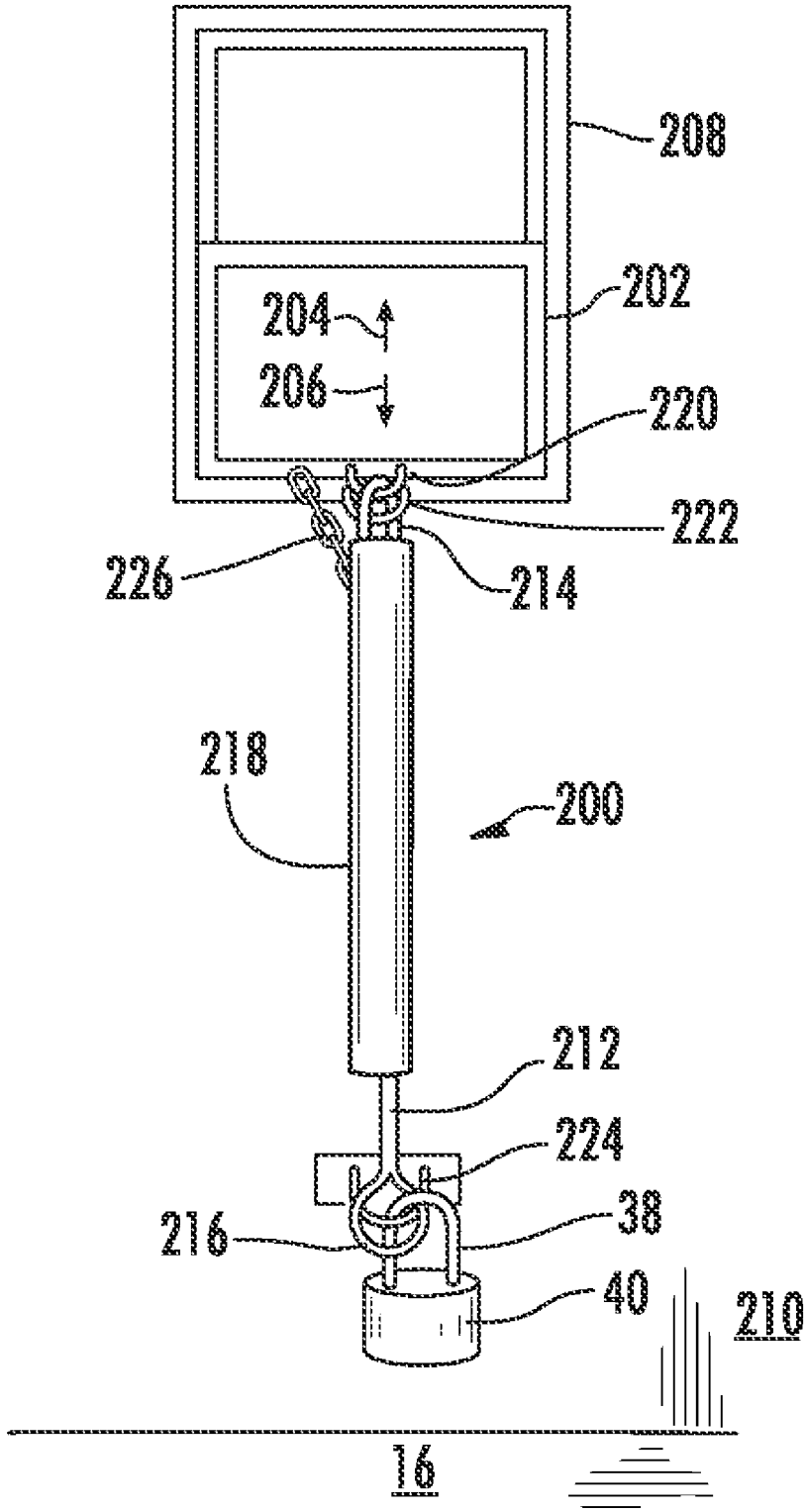
FIG. 7 is a somewhat schematic perspective illustration of an apparatus configured to secure a window.

FIG. 7 illustrates an apparatus 200 that is configured to secure a window 202 that opens and closes by relative movement in the translocation directions 204 and 206 with respect to a window frame 208. In the configuration of FIG. 7 the window 202 is in a closed position. The window frame 208 is a fixed structure and is operatively secured to a wall 210 that is operatively secured to a floor 16. The apparatus 200 has an extender 212 and there is a hook 214 at a first end of the extender 212 and a loop 216 at a second end of the extender 212. There is a rigid sheath 218 that surrounds a substantial portion of the extender 212. A first staple 220 is operatively secured to the window 202 and a second staple 222 is operatively secured to the window frame 208. The hook 214 operatively secures the first staple 220 to the second staple 222. A third staple 224 is operatively secured to the wall 210. A shackle 38 of a padlock 40 operatively secures the loop 216 to the third staple 224. In the configuration of FIG. 7 a movement of the window 202 relative to the window frame 208 is limited to not more than approximately one inch.

A chain 226 is operatively secured to the rigid sheath 218 and the window 202. The chain 226 is an example of a "linkage." Other examples of a linkage are a rod and a strap. If the shackle 38 is removed from the third staple 224 and the loop 216, and the hook 214 is removed from the first staple 220 and the second staple 222, the rigid shaft 218 may be pushed in the direction 204 and the when the chain 226 becomes taut, further pushing on the rigid shaft 218 will open the window 202. In an alternative embodiment the chain 226 may be attached to the hook 214 and pushing on the extender 212 will open the window 202. However, attaching the chain 226 to the rigid shaft 218 (as depicted in FIG. 7) is preferred because the chain 226 as configured in FIG. 7 prevents the rigid shaft from moving in the direction 206 and exposing the tip of the hook 214 when the rigid sheath 218 is in the closed state.

Figure 8:
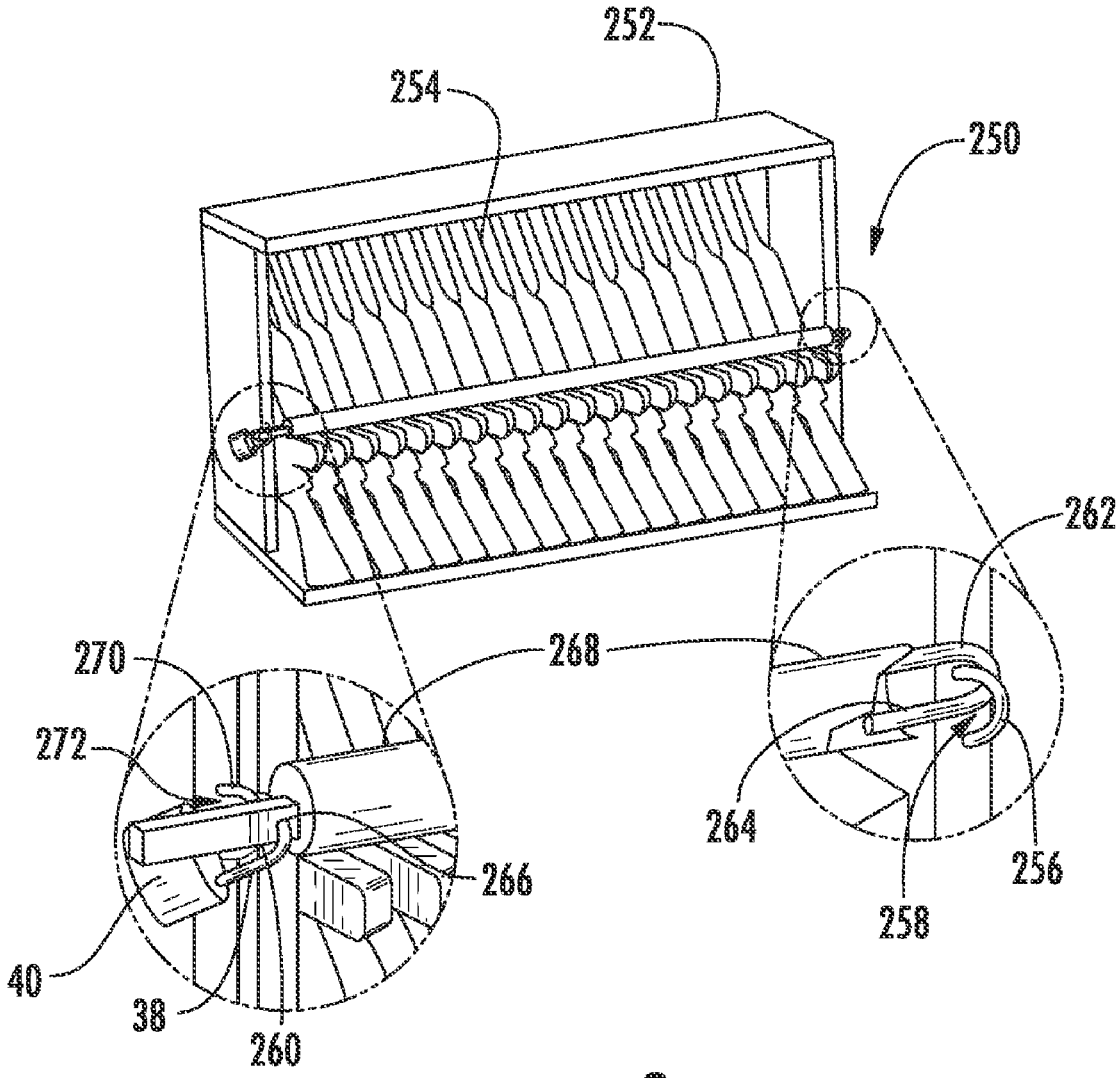
FIG. 8 is a somewhat schematic perspective illustration of an apparatus configured to secure a case.

FIG. 8 illustrates an embodiment of an apparatus 250 for securing an article in a storage case 252. In this embodiment the article is a rifle 254, and a plurality of rifles (254) is depicted in the storage case 252. The apparatus 250 includes a first staple 256 that is operatively secured to the storage case 252, and the first staple 256 has a first eye 258. There is an extender 260 that has a hook 262 with a tip 264 at a first end. The extender 260 also has an annulus 266 at a second end of the extender 260 that is distal from the first end. In the configuration illustrated in FIG. 8, the hook 262 is disposed through the first eye 258. There is a rigid sheath 268 that encloses the tip 264 of the hook 262, such that in the closed state depicted in FIG. 8 the hook 262 cannot be removed from the eye 258 of the first staple 256 without breaking the first staple 256, or breaking the hook 262, or breaking the rigid sheath 268, or without moving the rigid sheath 268 to an open state. There is a second staple 270 that is operatively secured to the case 252 at a position that is distal from the first staple 256. The second staple 270 has a second eye 272. There is a shackle 38 that is configured to pass through the second eye 272 and the annulus 266 of the extender 260 to operatively secure the second staple 270 to the extender 260. Thus the rigid sheath 268 and the extender 260 are configured to prevent the removal of the rifle 254 from the case 252.

In summary, various embodiments are disclosed herein for an apparatus for securing a closure, such as a door or a window that opens and closes by movement relative to a fixed structure such as a floor or a wall. Also disclosed are embodiments for securing a closing fastener to an annular fastener. Further disclosed are embodiments of an apparatus for securing an article in a protective case.

The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. An apparatus for securing a closure that opens and closes by movement relative to a fixed structure, the apparatus comprising:

a first annular fastener having a first eye, the first annular fastener being operatively secured to a first fixing surface selected from the group consisting of the closure and the fixed structure;

a second annular fastener having a second eye, the second annular fastener being operatively secured to a second fixing surface selected from the group consisting of the closure and the fixed structure, wherein one of (a) the first fixing surface and (b) the second fixing surface is on a surface of the fixed structure and the other of (a) the first fixing surface and (b) the second fixing surface is on a surface of the closure;

an extender having a length and a first end and an opposing second end;

a hook with a tip disposed at the first end of the extender and an annulus disposed adjacent the second end of the extender, the tip having an end;

a tubular rigid sheath having an interior volume and having an enclosing end and a locking end, the tubular rigid sheath being configured to enclose a portion of the length of the extender between the hook and annulus and configured to slide relative to the extender between (1) a closed state wherein the end of the tip of the hook is disposed within the interior volume of the tubular rigid sheath adjacent the enclosing end of the rigid sheath and the annulus is disposed outside the interior volume of the tubular rigid sheath adjacent the locking end of the tubular rigid sheath and (2) an open state wherein the tip of the hook is disposed outside the interior volume of the tubular rigid sheath adjacent the enclosing end of the tubular rigid sheath and the annulus is disposed within the interior volume of the tubular rigid sheath adjacent the locking end of the tubular rigid sheath, such that when a shackle of a lock is disposed in the annulus in the closed state the tubular rigid sheath is prevented from sliding relative to the extender to the open state, wherein the hook is disposed through the first eye when the tubular rigid sheath and the extender are in the closed state;

a shackle disposed through the second eye and the annulus when the tubular rigid sheath and the extender are in the closed state, wherein movement of the closure relative to the fixed structure is limited to a fixed amount; and a chain separate from the second annular fastener, the chain being disposed between the closure and at least one element selected from the group consisting of the tubular rigid sheath and the hook, the chain comprising a series of flexibly-connected interconnecting rings;

wherein the extender is detachable from the closure and the fixed structure by first removing the shackle from the annulus when the tubular rigid sheath and the extender are in the closed state and second configuring the tubular rigid sheath and the extender in the open state wherein the hook is removable from the first eye.

2. The apparatus of claim 1 wherein the second annular fastener is a rigid structure rigidly attached to the fixed structure and the movement of the closure relative to the fixed structure is limited to substantially no movement when the tubular rigid sheath and the extender are in the closed state and a shackle is disposed through the second eye and the annulus.

3. The apparatus of claim 1 wherein the movement of the closure relative to the fixed structure is limited to one inch when the tubular rigid sheath and the extender are in the closed state and a shackle is disposed through the second eye and the annulus.

4. The apparatus of claim 1 wherein the closure is a door or a window or a gate.

* * * * *